United States Patent [19]

Grass

[11] Patent Number: 4,783,131

[45] Date of Patent: Nov. 8, 1988

[54] FITTING FOR A CUPBOARD WITH OVERHEAD OPENING DOOR

[75] Inventor: Alfred Grass, Höchst/vlbg., Austria

[73] Assignee: Alfred Grass Ges.m.b.H. Metallwarenfabrik, Höchst/vlbg., Austria

[21] Appl. No.: 111,247

[22] Filed: Oct. 22, 1987

Related U.S. Application Data

[63] Continuation of Ser. No. 852,431, Apr. 15, 1986, abandoned.

[30] Foreign Application Priority Data

Apr. 16, 1985 [AT] Austria ..... 1129/85

[51] Int. Cl.[4] ..... E05D 15/42

[52] U.S. Cl. ..... 312/276; 312/319; 49/252

[58] Field of Search ..... 312/109, 138 R, 275, 312/276, 313, 315, 319, 323; 49/248, 250, 252

[56] References Cited

U.S. PATENT DOCUMENTS

| | | | |
|---|---|---|---|
| 1,356,346 | 10/1920 | Edholm | 49/252 |
| 2,006,603 | 7/1935 | Nordmark et al. | 312/323 |
| 2,637,615 | 5/1953 | Theobald | 312/276 |
| 2,648,878 | 8/1953 | Albano | 49/252 |
| 2,718,675 | 9/1955 | Olsen | 49/252 |
| 2,763,900 | 9/1956 | McAfee et al. | 49/250 X |
| 2,869,954 | 1/1959 | Kesling | 312/275 |
| 3,721,044 | 3/1973 | Kvasnes | 49/252 X |
| 3,722,142 | 3/1923 | Anderberg et al. | 49/252 X |
| 4,364,201 | 12/1982 | Taylor | 49/248 |
| 4,516,813 | 5/1985 | Sekerich | 312/323 |

FOREIGN PATENT DOCUMENTS

| | | |
|---|---|---|
| 7811011 | 8/1978 | Fed. Rep. of Germany . |
| 133046 | 9/1983 | Fed. Rep. of Germany . |
| 2025499 | 1/1980 | United Kingdom . |

*Primary Examiner*—Joseph Falk

[57] ABSTRACT

A swiveling assembly for a cupboard having interior side walls, a top and shelving, and a door having an upper, mid, lower and side portion, the assembly providing for pivotal movement of the door outwardly and upwardly over the head of the user whereby the door is arranged to extend generally vertically when in the closed position and to extend outwardly and generally horizontally form an upper portion of the cupboard when in an open position, it has a vertical guide means affixed to the cupboard, slide means moveably mounted within the cupboard and pivotally connected to the door, pivot arms means connected to the door and the interior walls of the cupboard, and spring means connected with an upper portion of the side walls of the cupboard and the door to assist in opening and counterbalancing the door in its open position.

4 Claims, 7 Drawing Sheets

3
58"
11"
60"
44"
63"
61"
62"
43"
-7-
59"
45"
2"
60'
11'
44'
74
43'
59'
16
62'
64
45'
58
2'
60
61'
63
11
44
2
-2-
63
61
56
57
62
64
67
43
X
45
16
59
43
76
5
5
77
72

58
65
7
60
66
44
63
61
62
64
67
43
45
16
59

FITTING FOR A CUPBOARD WITH OVERHEAD OPENING DOOR

This application is a continuation of U.S. patent application Ser. No. 852,431, filed 4/15/86, now abandoned.

NATURE OF THE INVENTION

This invention concerns a swiveling assembly alternatively referred to as a fitting for a cupboard and a door positioned on the cupboard's front side which swings, through springs cooperatively associated with the fitting, over the head of the user when opened.

BACKGROUND OF THE INVENTION

A fitting of the prior art is shown in DE-GM Nos. 83 13 304.6 and 78 11 011. Both show a door connected to the fitting swinging toward the user during the opening operation whereby the user is forced to step back from the door to avoid being struck on the head. Such an arrangement can cause accidents and requires that the fitting be mounted low in the cupboard on the side wall thereby reducing shelf surface and diminishing the cupboard's usable volume.

Moreover, the use of flap fittings and foldable flap fittings are further limiting because they require the door to swing out above the upper edge of the cupboard thus making it impossible to build over the cupboard and requiring some space to be retained between the cupboard the kitchen ceiling. Such fittings are mainly suitable for relatively low doors. Because they are side-mounted, they usually take up a large share of the usable storage space of the cupboard.

OBJECTIVES OF THE INVENTION

A primary objective of the present invention is to provide a fitting for a cupboard that will prevent the cupboard door from swinging against the user during the opening operation. The objective is achieved by arranging the lever system to engage the lower half of the door on its inner side and to be vertically displaceable along the side walls of the cupboard whereby the door swings over the head of the user in a pivoting movement away from the cupboard. Thus, an ergonomically favorable opening movement of the door is achieved in that the user need only grasp the lower half of the door and pull it toward himself. The door is immediately lifted horizontally away from the cupboard by a spring levered system later to be described in detail. Since the upper part of the door begins its movement horizontally away from the face of the cupboard, any trim strips situated there will not be damaged.

A further objective of the present invention is to provide a lever system for a cupboard door, the lower part of which does not extend into the internal space of the cupboard thus providing an optimally usable storage space. This objective is met by swinging the cupboard door over the head of the user directly away from the cupboard. The lever system is designed in one embodiment to compensate for the weight of the door through adjustment of one or more springs with the lever system.

Another abjective of the present inventive concept is to provide at least one pivot linkage for an additional pivot-mounting of the cupboard door above the point of application of the lever system on the inner side of the door and the upper half of the cupboard. The linkage forms a swivel arm which becomes the upper pivot mounting of the door while the lever system forms the door's lower pivot mounting. The lower lever system and the upper pivot linkage form a 4 point linkage.

As an alternative to a linkage in the form of a swivel arm, it is possible to form the linkage as a cord of fixed length which will transfer the weight of the door to the cupboard.

When the pivot linkage is a rigid pivot arm, it is possible to effect a balancing of the door by introducing, at an angle to the longitudinal access of the swivel arm, at least one spring proximate the swivel arm and engagable with the cupboard.

Because the lever system and the pivot linkage engage the inner side of the door and the door swings away from the cupboard up over the user, the complete guide system of the door is not visible to the user when opening the door. The user thus has immediate access to the storage space of the cupboard without the awkward extension of parts into the cupboard interior or the fittings being apparent to the user. The vertical displacement guide necessary for the lever system is visible only as a narrow guide section on the front inner side of the cupboard.

When the door is closed, the swivel arm and springs are nearly parallel to and operate at a short distance from the inner surface of the door. Therefore, only a very small depth of cupboard is necessary for the middle swivel fitting when the door is closed. The shelving does not need to be reduced, and the storage space in the cupboard is optimally usable.

Another objective of the present invention is to provide another embodiment having a two point mounting in which the slide is connected to only a single joint, and the joint access is arranged in a retainer recessed into the inner side of the door.

These and other objectives of the present invention will become more apparent after a consideration of the following detailed specification taken in conjunction with the accompanying drawings wherein like parts of reference designate like parts throughout the several views.

FIGURE DESCRIPTION

DETAILED DESCRIPTION OF THE INVENTION

Figure 1:
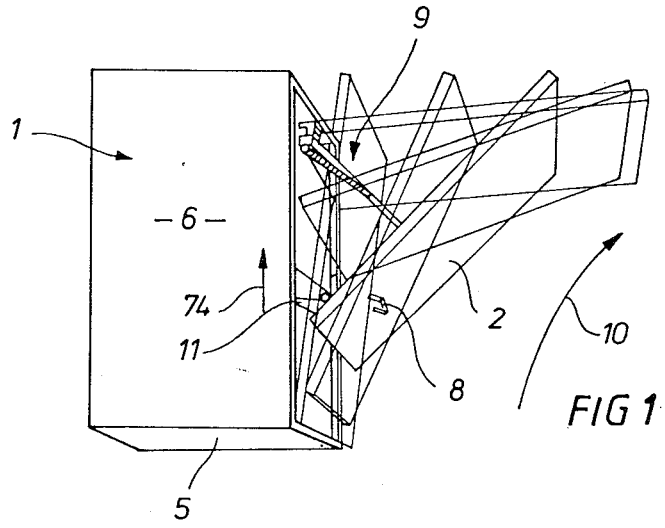
FIG. 1 is a schematic perspective view of a cupboard and door showing the swivelling action of the door in varying open positions.

FIG. 1 shows the operational movement of a door 2 secured to the front of a cupboard shown generally as 1 in cooperative engagement with a fitting designated generally as 9. Movement of the door is in the direction of arrow 10 with respect to cupboard 1 which has a top surface 3, a lower surface 5 and side walls 6, 7. Shelves 4 are arranged inside the cupboard 1 in a parallel and equadistant relationship.

Figure 4:
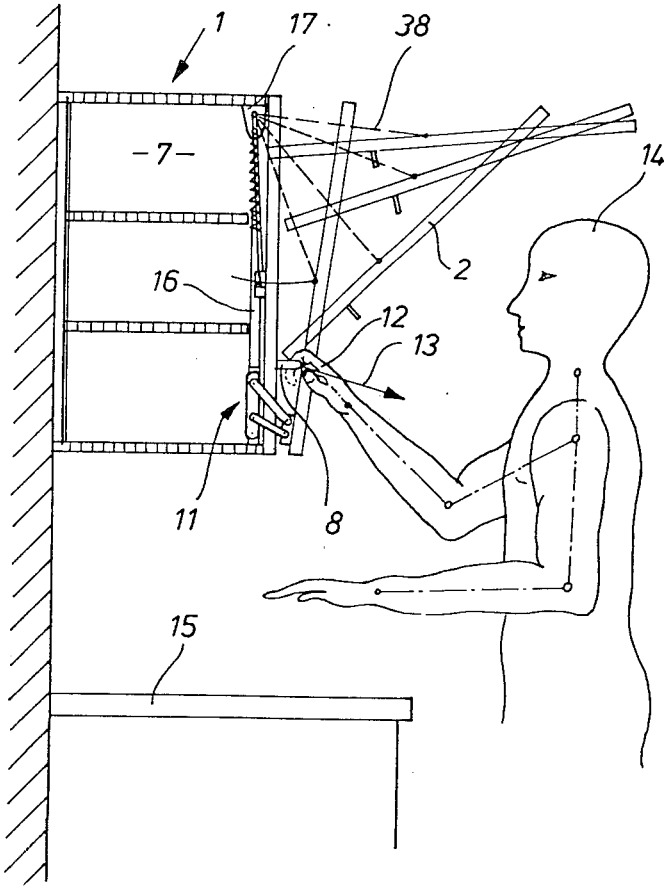
FIG. 4 is a side elevational sectional and schematic view of the cupboard and door of FIG. 1 showing the positioning of the door by a user from the closed to the open position.

As the door is opened, it swings outwardly and upwardly as shown in FIGS. 1 and 4 whereby a lever system shown generally as 11 is fastened to each side wall 6, 7 and moves in a vertical direction as indicated by arrow 74.

Top surface 3 of cupboard 1 is not overlapped by the door 2 in the open position (see FIG. 2) thus eliminating any need for a gap or space between top surface 3 and the ceiling of the room in which the cabinet is hung. This is a decided advantage over other prior art cabinet fittings.

Note that shelves 4 present no obstruction during the opening movement of door 2. The shelves can extend to within approximately 20 millimeters of the front face of cupboard 1 thereby creating optimal usable storage space therein.

Figure 2:
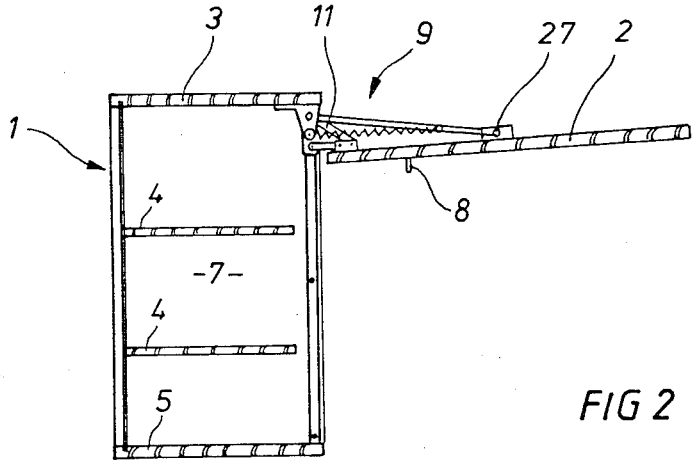
FIG. 2 is a side elevational sectional view of the cupboard and door of FIG. 1 with the door in the open position.
Figure 3:
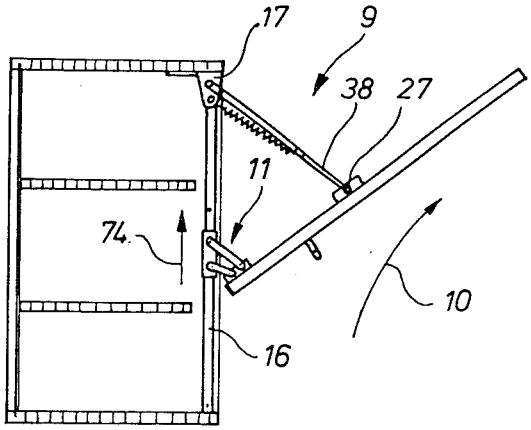
FIG. 3 is a side elevational sectional view of the cupboard and door of FIG. 1 with the door in the partially opened position.

FIGS. 2 and 3 illustrate the pivotal connection of the door 2 with the cupboard 1 by fitting shown generally as 9 which in total comprises a four point mounting. Fitting 9 consists of swivel arm 38 and lever system 11 arranged at a distance from it. Swivel arm 38 and level system 11 form two separate attachment points on the interface of door 2 whereby the pivot point of swivel arm 38 on the cupboard side is fixed and the pivot point of the lever system 11 slides vertically in the direction of arrow 74.

The weight of door 2 is mainly carried by swivel arm 38 which preferably is arranged as a single swivel arm in the middle of the interface of door 2. In an alternative embodiment (not shown), it is possible to use two parallel-mounted swivel arms in the place of a single arm 38. It is also possible to substitute for the rigid swivel arm 38 a cord, chain or a plastic strip.

By means of the four point mounting 9 of door 2 on cupboard 1, only a slight torque occurs about pivotal axis 27 on the door side in the open position as shown in FIG. 2.

Figure 5:
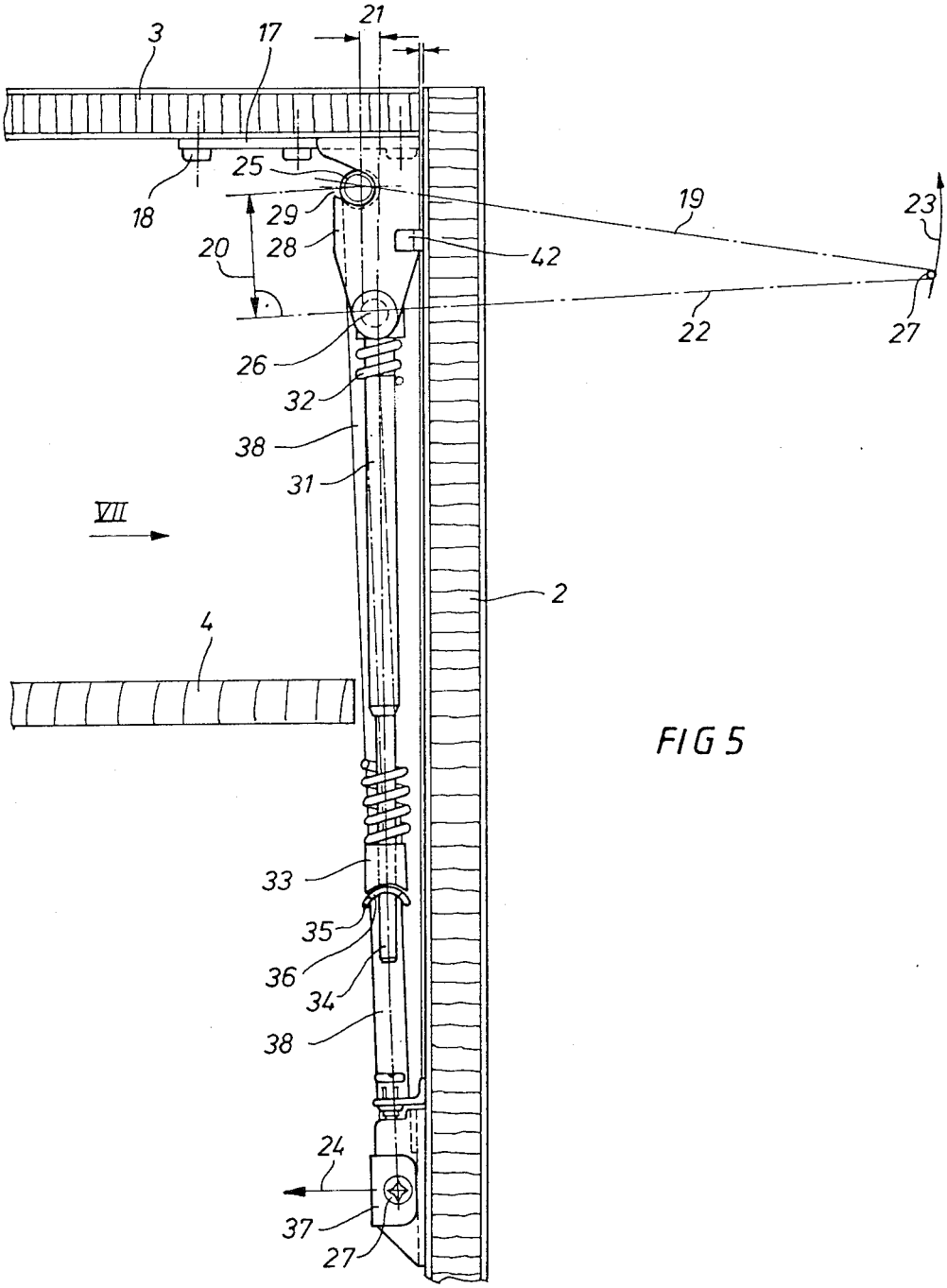
FIG. 5 is a side elevational, sectional and enlarged view of the cupboard and closed door showing a spring and spring guide sleeve fastened to the door and the cabinet with the door in the closed position.
Figure 6:
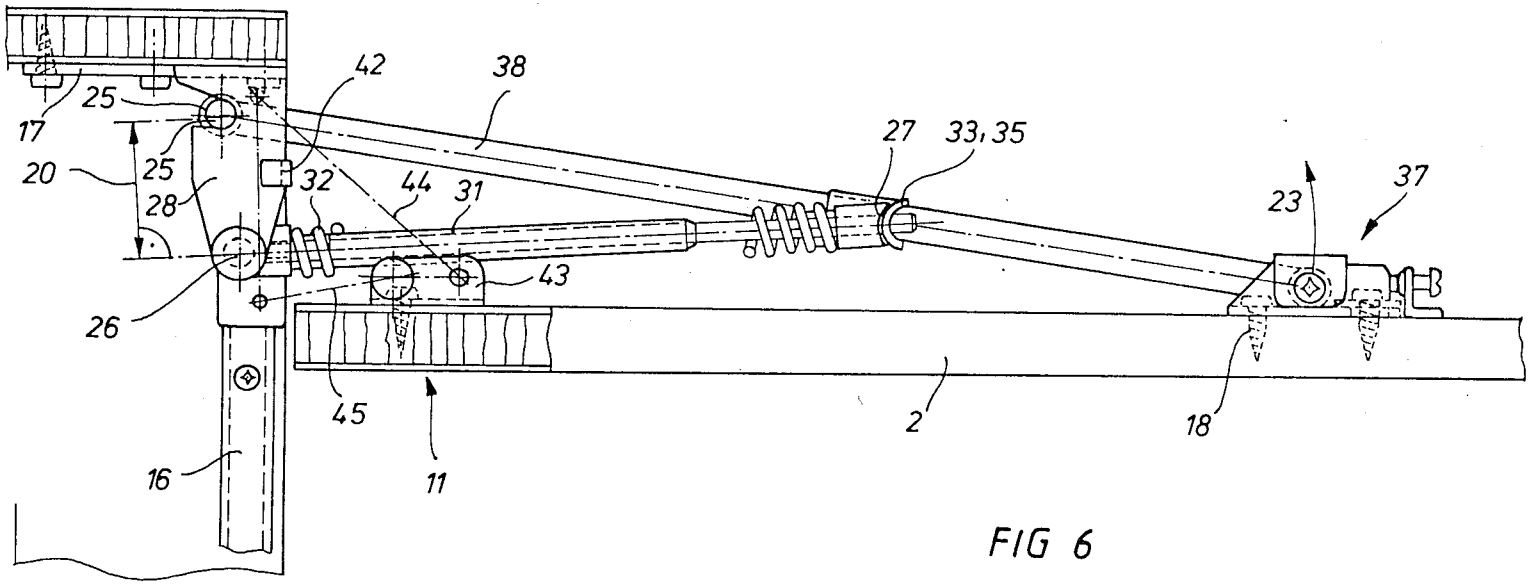
FIG. 6 is a side elevational sectional and enlarged view of that section of the cupboard and door shown in FIG. 5 with the door in the open position.
Figures 7, 8, 8A:
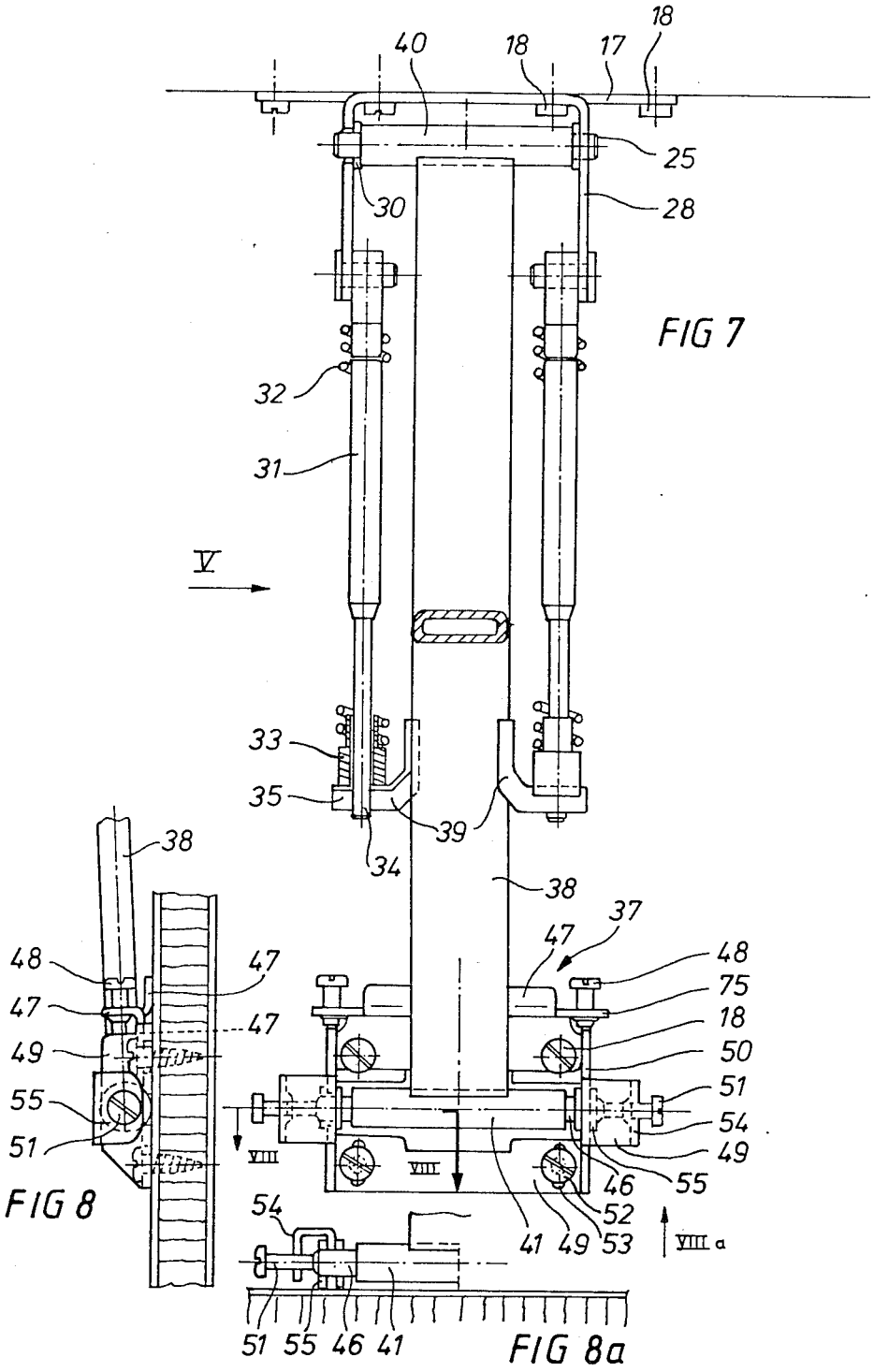
FIG. 7 is a plan sectional and enlarged view of that portion of the cupboard and door shown in FIGS. 5 and 6.
FIG. 8 is a side elevational sectional and enlarged view of the cupboard door to which is affixed as the swivel arm.
FIG. 8a is a front elevational view of the cupboard door and swivel arm shown in FIG. 8.

FIGS. 3 and 7 show mounting flange 17 connected to swivel arm 38 and secured in the middle of the cupboard on the under side of top surface 3. A spring arrangement is provided at an angle acute to the longitudinal axis of swivel arm 38 to counterbalance the door in the open position and deliver opening thrust. The spring arrangement consists of two parallel coil compression springs 32 glidably positioned over spring guide sleeves 31 as shown in FIGS. 5, 6 and 7. Obviously, it is possible to utilize a single spring rather than two parallel springs if space or other considerations deem it necessary. Moreover, a range of equivalent devices such as gas or air cylinders may be used in lieu of coil compression springs.

Figures 9, 10:
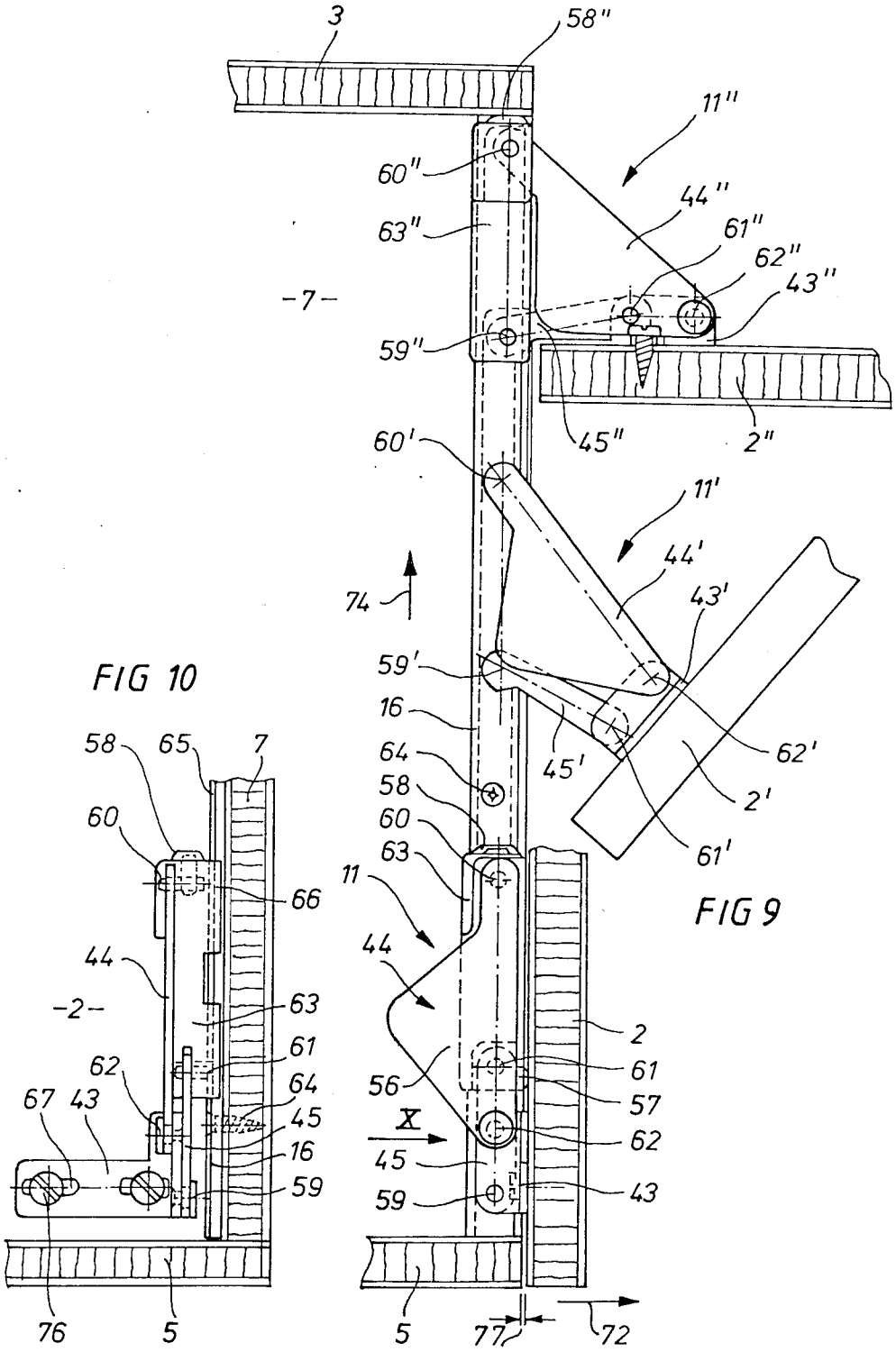
FIG. 9 is a side elevational sectional and schematic view of the lever system shown in three different positions.
FIG. 10 is a front elevational sectional view of the lever system shown in FIG. 9.

Lever system 11 is pivoted on a slide 63 as shown in FIG. 10. This system maintains the necessary clearance between door 2 and cupboard 1 in all positions of the door when it is not closed. It also enables the parallel fitting of door 2 with respect to cupboard 1 in the closed position. While it is desirable to use a slide 63 on each side wall, no connecting or synchronizing linkage is necessary to enable these devices to function properly.

When door 2 is opened by the user, its movement after opening is initated is taken over automatically by spring 32 which swings door 2 through the position shown in FIGS. 1 and 4 upwards in the direction of arrow 10. Since door 2 swings away and up over the head of the user, it is possible that the user can remain standing close without fear of being struck by the ascending door.

The opening movement of door 2 in the direction of arrow 13 can be either vertical parallel to the plane of the door or obliquely downwards depending on the size of the user. The door need only be moved into the slightly tilted position shown in FIG. 4 by hand, and all other movements follow automatically until the fully opened condition is achieved. As door 2 opens, it lifts away from the front of cabinet 1 so that no grading or rubbing resulting in an irritating noise or wear occurs.

When door 2 is in a closed position, springs 32 are almost parallel to swivel arm 38 thereby allowing shelves 4 to extend near the front side of cupboard 1. The centrally arranged swivel arm 38 with its springs 32 thus is constructed in a unique space-saving manner.

When door 2 is fully raised, the complete fitting 9 consisting of the swivel arm 38 and its springs together with the lever system 11 on both side walls 6, 7 is not visible. In the open position, only guide rails 16 fastened to inner faces of side wall 6, 7 to receive slide 63 of each lever system 11 are visible. Each guide rail 16 consists of a shallow I-member and is hardly noticeable.

A mounting flange 17 affixed to the underside of the cupboard top 3 is comprised of a plate which is fastened by screws 18. Flange 17 is connected to a U-shaped flange 28 whose legs are fitted with pivot pins 25 that are connected by sleeve 40 which in turn connects with swivel arm 38. Pivot pins 25 of sleeve 40 are interconnected by suitable bushings 30.

Swivel arm 38 is preferably formed from a hollow oval cross sectioned member as shown in FIG. 7 having a high torsion and bend resistance. In order to ensure that swivel arm pivot pins 25 can be removed from U-flange 28, slotted recesses 29 are provided whereby the recess open end faces toward the inside of cupboard 1.

The front ends of the legs of U-shaped member 28 are provided with pivot bearings 26 which accept spring guide sleeve 31. Sleeve 31 supports spring 32 which engages a shoulder at one end of spring guide sleeve 31 in the vicinity of pivot bearing 26 and spring retainer 33 on the other end of guide 31. The end of retainer 33 is hemispherical in configuration and is positioned on the surface of a low friction pressure mounting 35 which is affixed to retaining bracket 39 which in turn joins swivel arm 38 as shown in FIG. 7.

A bolt 34 associated with spring guide sleeve 31 extends through a low friction pressure mounting 35 near a slotted hole 36. When door 2 swings out, spring retainer 33 exerts a force against pressure mounting 35 and bolt 34 moves within hole 36 of pressure mounting 35. In the closed position, a closing moment is created in the closing direction 24 which is determined by multiplying the spring pressure by the normal distance 21. Line 19 shows the swivel arm open position whereas line 22 shows the force application line of spring 32 in the opened position.

In the open position, the open retaining moment is determined by multiplying the spring pressure by the normal distance 21. This moment is reflected by arrow 23 on shaft 27 of mounting flange 37 for swivel arm 38. Compression springs 32 are compressed about the normal distance 20 in the open position.

A damper 42 is positioned on the front face of the U-shaped flange carried on the inner side of door 2.

When door 2 is open, fitting 11, 9 assumes the position shown in FIG. 6. The pressure from springs 32 multiplied by distance 20 yields the counterbalancing moment which offsets the weight of the door and fitting. During the changeover from the open position in FIG. 6 to the closed position in FIG. 5, spring 32 is compressed until it is shorter in the closed position by distance 20. Thus, the torque acting on the door in all moving positions is almost constant. The door can therefore swing uniformly to its open position without unwanted acceleration, abrupt movement or high impact.

Door 2 may be adjusted with respect to its opening with respect to cabinet 1 where swivel arm 38 connects to door 2. The door end of swivel arm 38 is secured to a lower sleeve 41 that is affixed to shafts 46. Shafts 46 are rotatably mounted in sleeves 55 that are secured in the leg of U-shaped bracket 54. U-shaped bracket 54 is a part of a width and height adjustment mounting plate 49.

Mounting plate 49 is affixed to the interface of door 2 by locking screws 52. Screws 52 are positioned in slotted holes 53 which have their longitudinal axes aligned parallel to the longitudinal axis of the swivel arm. Mounting plate 49 is secured to brackets 54 and forms two parallel separated legs 50.

A positioning plate 47 is secured on the inner surface of door 2 by fixing screws 18. Lugs having threaded holes therein receive height adjusting screws 48 on positioning plate 47.

Door height is adjusted by loosening locking screws 52 of mounting plate 49 and thereby allowing both height adjusting screw 48 to be adjusted together or individually. The engagement of height adjustment screw 48 with leg 50 of mounting plate 49 moves mounting plate 49 and locking screws 52 in slotted holes 53.

Height adjustment screws are also utilized to obtain certain sideways movement of the door. Such adjustment is initiated by tightening locking screws 52. Adjustment screws 51 are each threaded into corresponding holes in bracket 54 so that their threaded portions bear on the corresponding front face of shafts 46. If an adjustment screw 51 is threaded into the hole, then the other adjustment screw 51 must be removed from its threaded hole by a corresponding amount whereby swivel arm 38 moves over vertically to its longitudinal axis and shafts 46 are moved in an axial direction in the area of the sleeve 55. After a sideways adjustment, adjustment screws 51 are re-tightened.

Lever system 11 includes a guide rail 16 positioned vertically on the inner side 6, 7 of cupboard 1 secured by screw 64. Guide rail 16 is formed of an I-shaped member over which is fitted a slide 63 preferably made from plastic which has an angular portion 66 engaging leg 65 of the I-shaped member. A damper 58 is provided on the upper face side of slide 63 as shown in FIG. 9.

Levers 44 and 45 are affixed to slide 63 as shown in FIG. 9. Lower lever 45 is shorter than upper lever 44. Lever 45 is pivotally mounted on slide 63 at pivot axis 61. Pivot axis 59 connects lever 45 with mounting plate 43 affixed to door 2. Screw 76 extends through slided hole 67 within mounting plate 43 so that sideways adjustment of lever system 11 with respect to door 2 is available.

Lever 44 is pivotally mounted on the slide 63 at axis 60. Its other end is affixed to mounting plate 43 by a rivet at pivot axis 62. Lever 44 is preferably connected to a triangular finger protection plate 56 which prevents engaging the fingers of the user in the space between levers 44 and 45 during the door opening operation.

The door gap 77 can be adjusted by selective movement of distance retainer 57 carried by slide 63 that bears against the inner face of the door.

FIG. 9 illustrates 3 positions of the lever system 11 at various locations of door 2 during the closed, partially opened and open condition.

Figure 11:
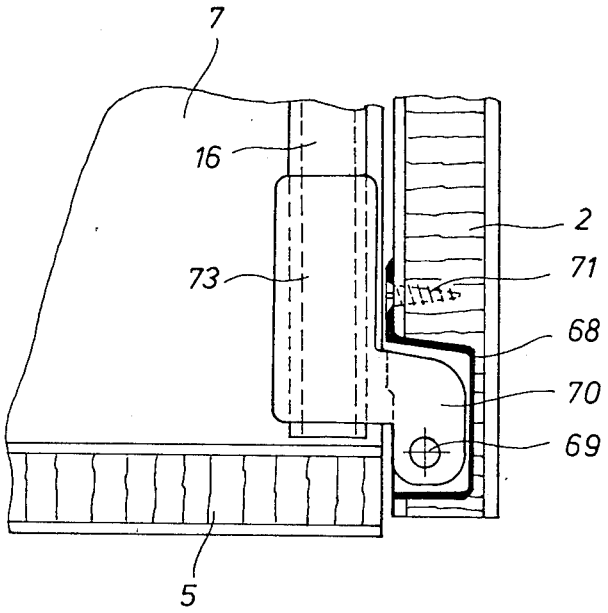
FIG. 11 is a side elevational sectional enlarged and fragmentary view of another embodiment of the lever system of FIG. 9 with the door in the closed position.
Figure 12:
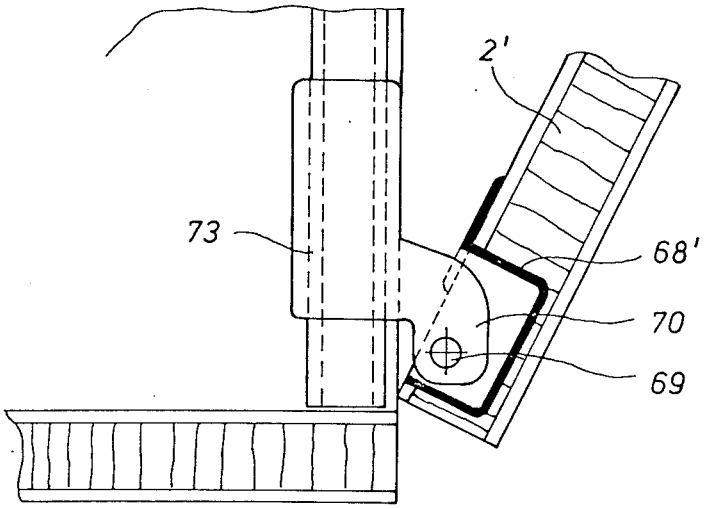
FIG. 12 is an enlarged side elevational sectional, fragmentary view of the lever system shown in FIG. 11 with the door in the partially open position.

FIGS. 11 and 12 illustrate alternative embodiments of the lever system utilizing a single joint mounting which consists of a slide 73 connected to an arm 70 which has on its lower end a pivot 69 mounted in bearing 68 recessed in door 2. Bearing 68 is secured on the inner face of door 2 by screw 71.

A completely automatic opening and closing of door 2 can be achieved with a fitting similar to that shown in FIG. 7 utilizing a stepping motor (not shown) engaging pivot pin 25 to rotate at approximately one-half revolution. The door is moved out of the closed position as shown in FIG. 4 into a slightly tilted position and is moved again by further rotation of the pivot pin by the stepping motor so that the door 2 is swung automatically into the open position. The door can be automatically swung from the open position into the closed position again. As an alternative to an electric motor, pneumatic or hydraulic drive systems can be employed.

While there has been illustrated and described in detail a preferred and some alternative embodiments of the present invention, it will be understood that various changes and modifications may be made in the details thereof without departing from the spirit and scope of the invention as set forth in the appended claims.

Having thus described the invention, what is claimed is:

1. A swiveling assembly for a cupboard having fixed interior side walls with forward and rearward edges, and a top, the assembly providing for pivotal movement of the door outwardly, forwardly, upwardly and over the head of a user, the assembly comprising: a door having an upper, mid, lower and side portion arranged to extend generally vertically when in a closed position and outwardly, forwardly, and generally horizontally from an upper portion of the cupboard when in an opened position; vertical guidemeans affixed near a forward edge of at least one of said interior side walls of the cupboard; slide means slidably mounted in the vertical guide means and pivotally connected with the lower portion of said door; swivel arm means pivotally connected to the center of said door at one end and pivotally connected at its other end proximate the underside of the top of the cupboard; and spring means extending from a point on said pivot arm means to a pivotal connection with the underside of the top of the cupboard to provide thrust to assist in opening said door and to counterbalance said door in its open position.

2. An assembly as claimed in claim 1 wherein said swivel arm means comprises an elongated flexible member bearing the load of said door when extended to the open position and collapsing when said door is moved to the closed position.

3. An assembly as claimed in claim 2 further comprising: a mounting plate on said door; and means for adjustably securing said mounting plate on said door for the adjustable position of said swivel arm.

4. An assembly as claimed in claim 3 wherein said pivot arm has one end connected to the center of said door and has at least one pin at its other end connected to a pivot axis comprising a U-shaped recess in a flange mounted on the underside of the top of the cupboard, and said spring means is mounted on two guide sleeves connected to and positioned on each side of said swivel arm.

* * * * *